US008511794B1

(12) United States Patent
Thompson et al.

(10) Patent No.: US 8,511,794 B1
(45) Date of Patent: Aug. 20, 2013

(54) METHOD AND APPARATUS FOR CLEANING MAGNETIC INK FROM A PRINTHEAD

(75) Inventors: Michael D. Thompson, Rochester, NY (US); Bruce Earl Thayer, Spenceport, NY (US); Varun Sambhy, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/489,807

(22) Filed: Jun. 6, 2012

(51) Int. Cl.
*B41J 2/165* (2006.01)

(52) U.S. Cl.
USPC ..... 347/33

(58) Field of Classification Search
None
See application file for complete search history.

(56) References Cited

U.S. PATENT DOCUMENTS

| | | | | |
|---|---|---|---|---|
| 4,563,086 | A | 1/1986 | Knapp et al. | |
| 5,095,317 | A * | 3/1992 | Takei | 346/74.2 |
| 5,337,122 | A | 8/1994 | Hubble, III et al. | |
| 6,909,856 | B2 | 6/2005 | Crichton | |
| 7,810,898 | B2 * | 10/2010 | Furukawa et al. | 347/21 |

* cited by examiner

*Primary Examiner* — Matthew Luu
*Assistant Examiner* — Alejandro Valencia
(74) *Attorney, Agent, or Firm* — Maginot, Moore & Beck, LLP

(57) ABSTRACT

A magnetic ink printer includes an ink collector to remove residual magnetic ink from a printhead face. The ink collector uses a magnetic member to produce a magnetic field that acts on the magnetic ink to remove the ink from the printhead face with little or no wiping of the printhead face. The magnetic ink is collected for possible reuse in the printhead.

24 Claims, 4 Drawing Sheets

METHOD AND APPARATUS FOR CLEANING MAGNETIC INK FROM A PRINTHEAD

TECHNICAL FIELD

This disclosure relates generally to inkjet printers that print documents with magnetic ink, and more particularly, to devices that clean ink from printheads in inkjet printers.

BACKGROUND

In general, inkjet printers include at least one printhead that ejects drops of liquid ink onto a surface of an image receiving member. In an indirect or offset printer, the inkjets eject ink onto the surface of a rotating image receiving member, such as a rotating metal drum or endless belt, before the ink image is transferred to print media. In a direct printer, the inkjets eject ink directly onto print media, which may be in sheet or continuous web form. A phase change inkjet printer employs phase change inks that are solid at ambient temperature, but transition to a liquid phase at an elevated temperature. Once the melted ink is ejected onto the media or image receiving member, depending upon the type of printer, the ink droplets quickly solidify to form an ink image.

Inkjet printers are used to print a wide range of documents using various types and colors of ink. Some printed documents are read by both humans and machines. For example, a check includes printed text that is both human readable and readable by automated check processing equipment. Check processing machines use Magnetic Ink Character Recognition (MICR) to identify printed characters in a check, such as routing and account numbers, quickly and accurately. The magnetic ink readable by MICR machines includes a suspension of magnetic particles, such as iron oxide, which are detectable using a magnetic field. The use of MICR printing is widespread and enables automated processing of checks and other documents even when the printed magnetic ink characters are visually obscured by stamps or other overprinting. Automated check processing machines perform high-speed character recognition using printed magnetic ink characters to identify account and routing numbers. While check processing is one application of magnetic ink printing, magnetic inks can be incorporated in a wide range of printed documents and can be used in conjunction with non-magnetic inks as well.

One challenge in using magnetic inks with inkjet printers relates to cleaning the magnetic inks from a printhead. Printers typically conduct various maintenance operations to ensure proper operation of the inkjets in each printhead. One known maintenance operation removes particles or other contaminants that may interfere with printing operations from each printhead in a printer. During such a cleaning maintenance operation, the printheads purge ink through some or all of the inkjets in the printhead. The purged ink flows from inkjet apertures located in a faceplate of each printhead onto the faceplate. The ink rolls downwardly under the influence of gravity to an ink drip bib mounted at the lower edge of the faceplate. The bib is configured with one or more drip points where the liquid ink collects and drips into an ink receptacle. In some printers, one or more wipers are manipulated to contact the faceplate of each printhead and wipe the purged ink toward the drip bib to facilitate the collection and removal of the purged ink.

While existing cleaning processes are useful to maintain printheads, removing residual purged ink from the printhead remains a challenge. This challenge is particularly significant in phase change magnetic ink printers since the ink in these printers can solidify and adhere to structures in the printer. Furthermore, magnetic inks contain small, very hard magnetite particles. Mechanical wiping of the printheads to remove purged ink can cause these particles to scratch the printhead face. Thus, improved cleaning of printheads that eject magnetic ink is desirable.

SUMMARY

In one embodiment, a method of cleaning a magnetic ink from a printhead is used that requires little or no wiping of the printhead. The method includes moving a magnetic member proximate to a printhead having magnetic ink located on a face of the printhead to enable a magnetic field emitted by the magnetic member to act on the magnetic ink and move the magnetic ink and collecting the magnetic ink after the magnetic ink has moved in response to the magnetic field acting on the magnetic ink.

In another embodiment, a device enables magnetic ink to be collected from a printhead with little or no wiping of the printhead. The device includes a magnetic member configured to move to a position where the magnetic member produces a magnetic field that acts on magnetic ink on a printhead face to move the magnetic ink, and a collecting member configured to collect the magnetic ink that moves in response to the magnetic field.

In yet another embodiment, a printer enables ink having magnetic particles to be collected from a printhead with little or no wiping of the printhead. The printer includes a printhead having a plurality of inkjet ejectors configured to eject ink through apertures in a faceplate of the printhead, a magnetic member configured to move to a position where the magnetic member produces a magnetic field that acts on magnetic particles in ink on the printhead faceplate to move the ink, and a collecting member configured to collect the ink that moves in response to the magnetic field.

DETAILED DESCRIPTION

Figure 1:
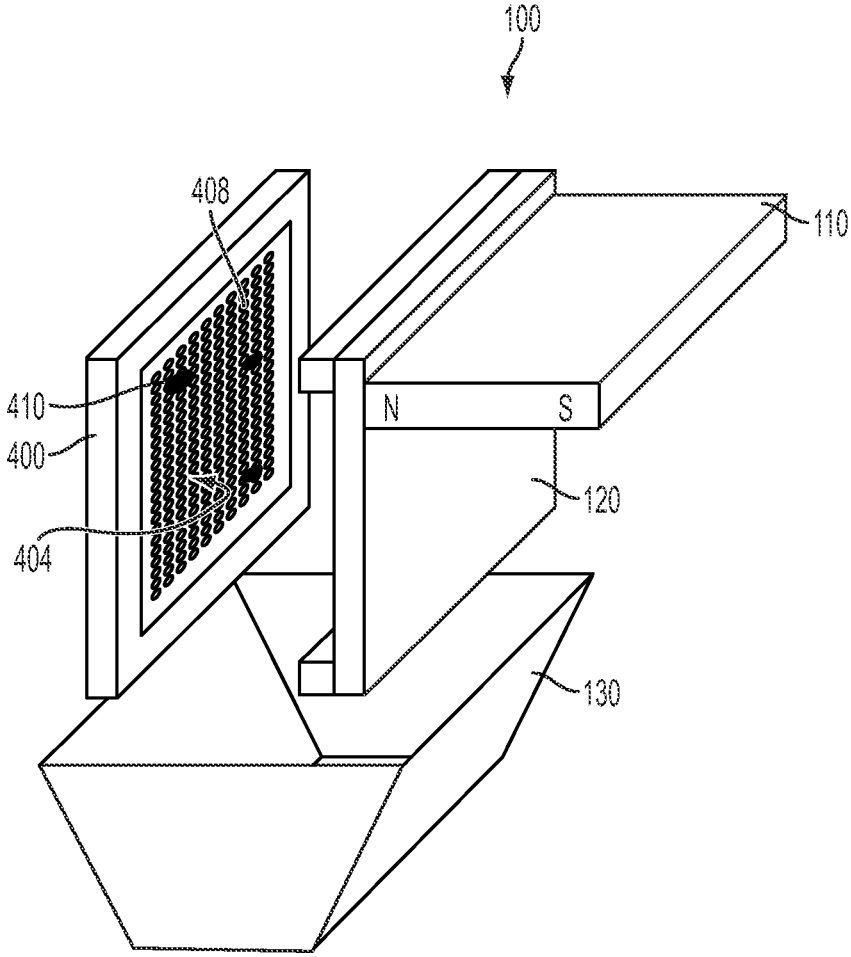
FIG. 1 is a side perspective view of a magnetic ink collector.

For a general understanding of the environment for the system and method disclosed herein as well as the details for the system and method, reference is made to the drawings. In the drawings, like reference numerals have been used throughout to designate like elements.

As used herein the term "printer" refers to any device that is configured to produce images made with one or more colorants on print media. Common examples of printers include, but are not limited to, xerographic and inkjet printers. Various printer embodiments use one or more marking agents, such as ink or toner, to form printed images in various patterns. An image receiving surface refers to any surface that receives a marking agent, such as an imaging drum, imaging belt, or various print media including paper. The term "substrate" refers to a print medium, such as paper, that holds printed images. In some embodiments, the printer is a digital printer. Digital printers enable an operator to design and modify image data to alter the image printed on the substrate easily using, for example, commercially available image editing software.

A continuous feed or "web" printer produces images on a continuous web print substrate such as paper. In some configurations, continuous feed printers receive image substrate material from large, heavy rolls of paper that move through the printer continuously instead of as individually cut sheets. The paper rolls can typically be provided at a lower cost per printed page than pre-cut sheets. Each such roll provides an elongated supply of paper printing substrate in a defined width. Fan-fold or computer form web substrates may be used in some printers having feeders that engage sprocket holes in the edges of the substrate. After formation of the images on the media web, one or more cutting devices separate the web into individual sheets of various sizes. Some embodiments use continuous feed printing systems to print a large number of images in a timely and cost efficient manner.

As used herein, the term "magnetic ink" refers to an ink that includes a suspension of magnetic particles in a liquid or phase-change medium. Some magnetic inks include a suspension of particles, such as iron oxide, in an aqueous or organic based solvent. Another type of magnetic ink is a phase-change magnetic ink. The phase-change magnetic ink is substantially solid at room temperature and includes magnetic particles that are distributed through the solid phase-change ink. When heated to a predetermined melting temperature, the phase change ink melts into a liquid with the magnetic particles suspended in the liquid ink. An inkjet printer ejects liquid drops of the phase-change magnetic ink onto an image receiving surface where the phase-change ink cools and returns to the solid state.

A magnetic ink collector 100 is shown in FIG. 1. The magnetic ink collector includes a magnetic member 110, a collecting member 120, and an ink receptacle 130. The magnetic member 110 is positioned adjacent to the collecting member 120 and configured to slide vertically along the collecting member 120. The collecting member 120 and magnetic member 110 are located above the ink receptacle 130 and the collecting member 120 is configured to enable ink 410 to fall into the ink receptacle 130 when the magnetic field emitted by magnetic member 110 is not acting on the magnetic ink 410. The collecting member 120 is coated with a hydrophobic chemical, for example polytetrafluoroethylene (commonly referred to as PTFE and sold commercially as Teflon®), ultra high molecular weight polyethylene (UHMWPE), silicones, fluorocarbons or other coatings, to enable the ink to flow freely from the collecting member 120 to the ink receptacle 130. In one embodiment, the magnetic member 110 is a permanent magnet, although in other embodiments the magnetic member is an electromagnet.

The magnetic ink collector 100 is in a printer having one or more printheads 400, each of which includes a printhead face 404. The printhead face 404 includes a plurality of inkjet apertures 408 through which inkjets eject magnetic ink. When a purge cycle is initiated, the inkjets release ink through the apertures 408 with a relatively low level of energy. The surface coating on the printhead face 404 is selected to correspond to properties of the ink 410 to enable minimal wetting of the printhead face to prevent contamination of the face, which may lead to poor inkjet performance. The magnetic ink collector 100 enables the ink that does not wet the printhead face to be removed from the printhead face to avoid print defects without mechanically wiping the printhead face.

Figure 2:
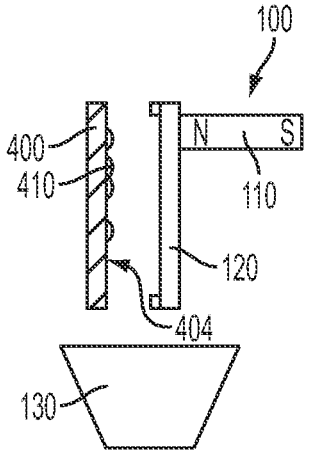
FIG. 2 is a side view of the magnetic ink collector of FIG. 1.
Figure 3:
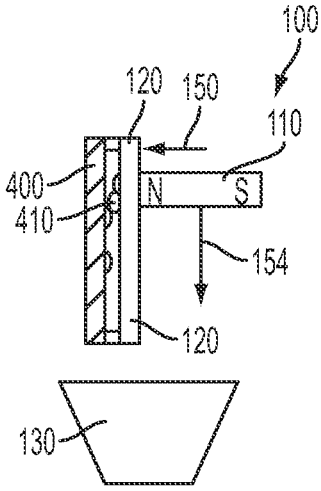
FIG. 3 is a side view of the magnetic ink collector of FIG. 1 showing a collecting member engaged with a printhead.

The magnetic ink collector 100 is positioned proximate to the printhead 400 after a purge cycle as shown in FIG. 1 and FIG. 2. The magnetic member 110 is in a first position relative to the collecting member 120. The collection member 120 and magnetic member 110 are moved in direction 150 until the magnetic member 110 is close enough that a magnetic field emitted by the magnetic member 110 is sufficiently strong to move the ink 410 on the printhead face 404 as shown in FIG. 3. The magnetic member 110 is then moved in direction 154 to pull the residual magnetic ink 410 from the printhead face 404 to the collecting member 120, where the ink 410 remains adjacent the magnetic member 110. The magnetic member 110 continues to move in direction 154 until reaching a second position in relation to the collecting member 120. At this second position, most or all of the ink 410 has been gathered from the printhead face 404 onto the collecting member 120.

Figure 4:
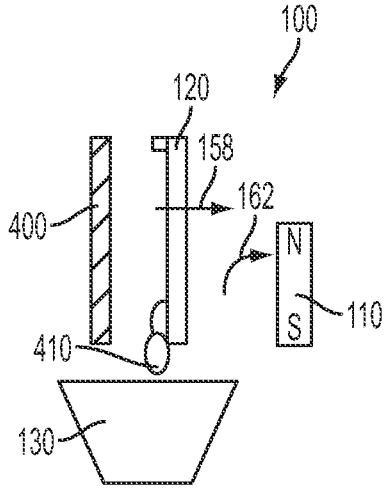
FIG. 4 is a side view of the magnetic ink collector of FIG. 1 showing a magnetic member moved away from a collecting member.

After the ink 410 has been collected on the collecting member 120, the magnetic member 110 is pivoted in rotational direction 162 (FIG. 4) or otherwise moved away from the collecting member 120. The magnetic member 110 moves away from the collecting member 120 to a distance where the magnetic field from the magnetic member 110 no longer acts on the ink 410. The ink 410, no longer being held on the collecting member 120 by the magnetic field emitted by magnetic member 110, flows off the collecting member 120 and into the ink receptacle 130. Once in the ink receptacle 130, the magnetic ink can be recycled back to the printhead 400 through a system of pumps and tubes or by dumping the ink receptacle 130 into an ink reservoir fluidly connected to the inkjet ejectors 408.

Figure 5:
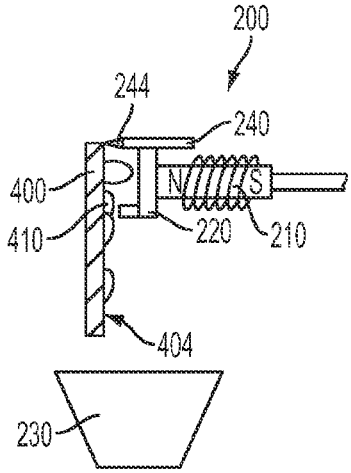
FIG. 5 is a side view of another magnetic ink collector.

Another embodiment of a magnetic ink collector 200 is illustrated in FIG. 5. The ink collector 200 includes a magnetic member 210, a collecting member 220, an ink receptacle 230, and a wiper 240. The magnetic member 210 is positioned adjacent to the collecting member 220. In the embodiment of FIG. 5, the magnetic member 210 includes an electromagnet that is operatively connected to a power source and can be selectively activated. The wiper 240 is positioned above the collecting member 210, and includes a wiper blade 244 that is configured to contact the face 404 of the printhead. The wiper blade 244 can be formed of an elastomer such as urethane, silicone, rubber, or any other suitable material.

Figure 6:
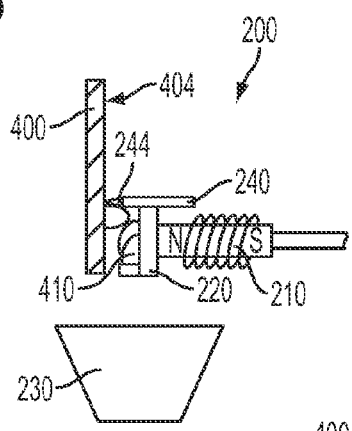
FIG. 6 is a side view of the magnetic ink collector of FIG. 5 illustrating a collecting member and magnetic member in a second position.

After the printhead 400 performs a purge cycle, the magnetic ink collector 200 is moved to the position shown in FIG. 5. The wiper blade 244 contacts the surface of the printhead face 404 with a pressure that is less than a predetermined threshold. The predetermined threshold corresponds to a pressure that enables the wiper to remove ink from the printhead face 404 without causing the magnetic particles in the ink to scratch the printhead face. The magnetic member 210, collecting member 220, and wiper 240 translate down the printhead face 404. The magnetic member 210 generates a magnetic field that acts on the magnetic ink 410 on the printhead face 404 to move the majority of the ink from the printhead face 404 to the collecting member 220. However, the magnetic field may not be strong enough to remove all ink 410 from the printhead face 404. The wiper blade 244 follows the magnetic member 210 down the printhead face 404 to break the surface energy of the ink 410 and printhead face 404. A low pressure wiper is sufficient to break the surface energy, and does not scratch the surface of the printhead 400 with the hard magnetite particles in the ink 410. Once the surface energy is broken, the magnetic field from the magnetic member 210 acts on the magnetite particles in the magnetic ink 410 to attract the ink 410 to the collecting member 220. The magnetic member 210, collecting member 220, and wiper 240 continue down the printhead face 404 to a predetermined ending position (FIG. 6).

Figure 7:
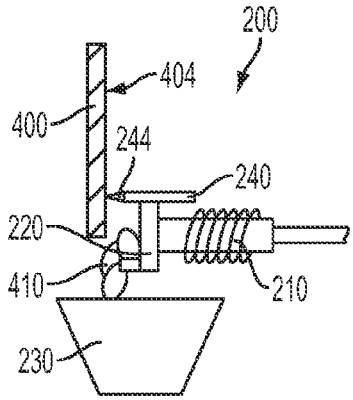
FIG. 7 is a side view of the magnetic ink collector of FIG. 5 showing an electromagnet deactivated.

After wiping the printhead face 404, the magnetic member 210, collecting member 220, and wiper 240 are positioned above the ink receptacle 230. In the illustrated embodiment, the ink receptacle 230 is located directly below the printhead 400. Alternatively, the ink receptacle 230 can be in a different location, and the magnetic member 210 and collecting member 220 can be moved to the location of the ink receptacle 230 while the magnetic field retains the ink 410 on the collecting member 220. Once the magnetic member 210 and collecting member 220 are positioned above the ink receptacle, the electromagnet of the magnetic member 210 is deactivated. As shown in FIG. 7, the ink 410 on the collecting member 220 falls into the ink receptacle 230 under the force of gravity after the electromagnet is deactivated. The collecting member 220 is coated with a hydrophobic layer to ensure that the ink 410 flows freely off the collecting member 220.

Figure 8:
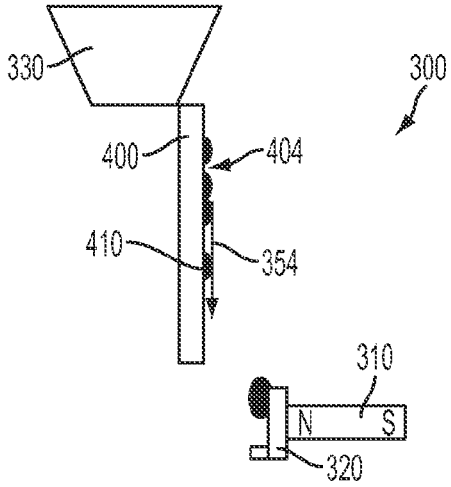
FIG. 8 is a side view of one embodiment of a magnetic ink collector.
Figure 9:
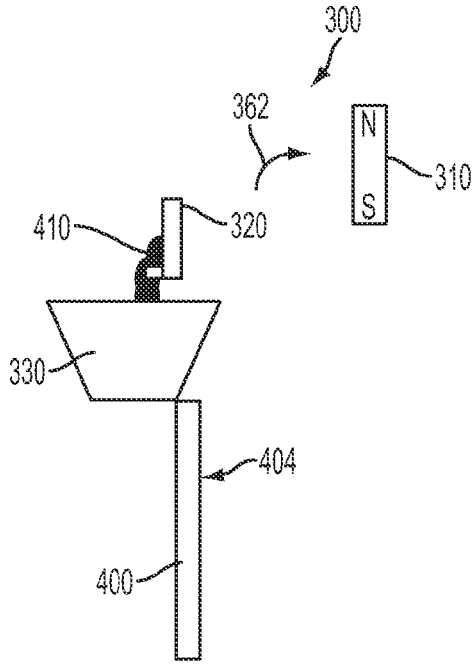
FIG. 9 is a side view of the magnetic ink collector of FIG. 8 showing a magnetic member moved away from a collecting member.

FIG. 8 and FIG. 9 depict another embodiment of a magnetic ink collector 300. The ink collector 300 includes a magnetic member 310 and a collecting member 320. The magnetic member 310 is adjacent to the collecting member 320 and configured to generate a magnetic field that acts on a lower portion of the printhead face 404. During and after a purge process, the ink collector 300 is positioned proximate to the bottom of the printhead face 404. The printhead face 404 of the embodiment of FIG. 8 and FIG. 9 has a low surface energy coating, which enables the ink 410 on the face 404 to slide down the printhead face 404, and, in some cases, reach the bottom portion of the printhead face 404. If the ink reaches the bottom of the face 404, the magnetic field of the magnetic member 310 acts on the ink 410 to move the ink 410 to the collecting member 320. The magnetic field retains the magnetic ink 410 on the collecting member 320 until the ink 410 is recycled.

To recycle the ink 410 collected in the collecting member 320, the magnetic ink collector 300 is moved above an ink receptacle 330. In the embodiment of FIGS. 8 and 9, the ink receptacle 330 is located above the printhead 400 and can be fluidly connected to a printhead ink reservoir (not shown) for reuse. The magnetic field continues to hold the ink 410 on the collecting member 320 until the collecting member 320 is positioned above the ink receptacle 330. The magnetic member 310 is then pivoted in rotational direction 362 or otherwise moved away from the collecting member 320 until the magnetic member 310 is sufficiently distant from the magnetic ink 410 that the magnetic field is too weak to influence the movement of the ink 410. Alternatively, a magnetic shunt can be inserted between the collecting member 320 and the magnetic member 310 to reduce the magnetic field acting on the ink 410. The shunt can be a sheet of ferromagnetic material, for example, soft iron, mild steel, or another magnetically soft material. The ink 410 can now drip into the ink receptacle 330 under the force of gravity. A hydrophobic coating on the collecting member 320 enables all the ink 410 on the collecting member 320 to fall into the ink receptacle 330, where the ink 410 can be recycled.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of cleaning a magnetic ink printhead comprising:

moving a magnetic member proximate to and along one dimension of a printhead, but not contacting the printhead, to enable a magnetic field emitted by the magnetic member to remove magnetic ink from a face of the printhead; and collecting the magnetic ink removed from the face of the printhead onto a collecting member with the magnetic field emitted by the magnetic member.

2. The method of claim 1 further including:

positioning the collecting member between the magnetic member and the printhead face to enable the magnetic ink removed from the printhead face to move to the collecting member.

3. The method of claim 2, the movement of the magnetic member along one dimension of the printhead further comprising:

translating the magnetic member from a first position adjacent the collecting member to a second position adjacent the collecting member.

4. The method of claim 2 further comprising:

wiping the printhead face with a wiper to break a surface energy of magnetic ink remaining on the printhead face after magnetic ink has been removed from the printhead face to enable the magnetic field emitted by the magnetic member to remove the remaining magnetic ink from the printhead face and onto the collecting member.

5. The method of claim 4 wherein the wiping is performed with a pressure that is less than a predetermined threshold.

6. The method of claim 2 wherein the magnetic member includes a permanent magnet.

7. The method of claim 6 further comprising:

positioning the collecting member and magnetic member above an ink receptacle; and moving the magnetic member away from the collecting member to enable magnetic ink on the collecting member to fall into the ink receptacle.

8. The method of claim 2 further comprising:

selectively activating an electromagnet of the magnetic member to move the magnetic ink out of engagement with the printhead face.

9. The method of claim 8 further comprising:

positioning the collecting member and magnetic member above an ink receptacle; and deactivating the electromagnet to allow magnetic ink on the collecting member to fall into the ink receptacle.

10. The method of claim 1, the magnetic ink being a magnetic phase change ink.

11. A device for collecting magnetic ink from a printhead comprising:

a magnetic member configured to move proximate a face of a printhead and along one dimension of the printhead to remove magnetic ink from the printhead face; and a collecting member configured to collect the magnetic ink removed from the printhead face by the magnetic field.

12. The device of claim 11 wherein the collecting member is interposed between the magnetic member and the printhead face.

13. The device of claim 12, the magnetic member being further configured to translate from a first position adjacent the collecting member to a second position adjacent the collecting member.

14. The device of claim 12 further comprising:

an ink receptacle configured to receive the magnetic ink from the collecting member.

15. The device of claim 11 further comprising:

a wiper configured to follow the magnetic member as the magnetic member moves along the one dimension of the printhead to break a surface energy of magnetic ink remaining on the printhead face to enable the magnetic field emitted by the magnetic member to remove the remaining magnetic ink from the printhead face and onto the collecting member.

16. The device of claim 11 wherein the wiper exerts a pressure on the printhead face that is less than a predetermined threshold.

17. The device of claim 11 wherein the magnetic member has a permanent magnet.

18. The device of claim 11 wherein the magnetic member has an electromagnet configured to be selectively activated.

19. The device of claim 11, the magnetic ink being a phase change ink.

20. A printer comprising:

a printhead having a plurality of inkjet ejectors configured to eject ink through apertures in a faceplate of the printhead;

a magnetic member configured to move proximate a face of a printhead and along one dimension of the printhead to remove magnetic ink from the printhead faceplate; and a collecting member configured to collect the ink removed from the printhead face by the magnetic field.

21. The printer of claim 20, the collecting member being interposed between the printhead faceplate and the magnetic member.

22. The printer of claim 21 further comprising:

an ink receptacle configured to receive the ink from the collecting member.

23. The printer of claim 20 wherein the magnetic member has a permanent magnet.

24. The printer of claim 20 wherein the magnetic member has an electromagnet configured to be selectively activated.

* * * * *